US007216944B2

(12) United States Patent
Oyler et al.

(10) Patent No.: US 7,216,944 B2
(45) Date of Patent: May 15, 2007

(54) DISHWASHER DOOR ASSEMBLY

(75) Inventors: Max Douglas Oyler, Louisville, KY (US); Jeffrey Thomas Kiesler, Louisville, KY (US); Deryl Craig York, Tempe, AZ (US); Lance Alan Wolf, Louisville, KY (US)

(73) Assignee: General Electric Company, Schenectady, NY (US)

( * ) Notice: Subject to any disclaimer, the term of this patent is extended or adjusted under 35 U.S.C. 154(b) by 71 days.

(21) Appl. No.: 09/930,721

(22) Filed: Aug. 15, 2001

(65) Prior Publication Data

US 2003/0205954 A1 Nov. 6, 2003

(51) Int. Cl.
*A47B 97/00* (2006.01)

(52) U.S. Cl. ..... 312/311; 312/109

(58) Field of Classification Search ..... 312/311, 312/236, 265.5, 265.6, 204, 279, 228, 109; D32/3, 2; 49/501
See application file for complete search history.

(56) References Cited

U.S. PATENT DOCUMENTS

| | | | | | |
|---|---|---|---|---|---|
| 2,871,082 | A | * | 1/1959 | Karig et al. | 312/213 |
| 2,905,092 | A | * | 9/1959 | Abresch | 417/363 |
| 3,098,686 | A | * | 7/1963 | Benoit | 312/348 |
| 3,294,461 | A | * | 12/1966 | Barnard et al. | 312/213 |
| 3,328,062 | A | * | 6/1967 | Geiger et al. | 292/123 |
| 3,908,681 | A | * | 9/1975 | Schimke et al. | 134/95.2 |
| 4,412,710 | A | * | 11/1983 | Laprad et al. | 312/311 |
| 4,765,697 | A | | 8/1988 | Gardell et al. | |
| 4,900,109 | A | | 2/1990 | Boston, Jr. et al. | |
| 5,255,968 | A | * | 10/1993 | Craven | 312/234 |
| 5,365,959 | A | | 11/1994 | Favaro | |
| 5,453,586 | A | | 9/1995 | Stottmann | |
| 5,537,300 | A | * | 7/1996 | Kraines et al. | 362/86 |
| D385,070 | S | * | 10/1997 | Hughes et al. | D32/3 |
| 5,698,826 | A | * | 12/1997 | Cracraft et al. | 200/5 A |
| 5,839,097 | A | * | 11/1998 | Klausner | 340/825.69 |
| 5,904,163 | A | * | 5/1999 | Inoue et al. | 134/56 D |
| 5,921,645 | A | * | 7/1999 | Lapi | 312/245 |
| 5,971,506 | A | * | 10/1999 | Dubin | 312/223.2 |
| D421,162 | S | * | 2/2000 | Roberts | D32/3 |
| D424,257 | S | * | 5/2000 | Umeda et al. | D32/2 |
| 6,098,411 | A | * | 8/2000 | Jeon | 62/125 |
| 6,190,712 | B1 | * | 2/2001 | Nam | 426/231 |
| D438,677 | S | * | 3/2001 | Roberts | D32/3 |
| 6,260,565 | B1 | * | 7/2001 | Welch et al. | 134/200 |

FOREIGN PATENT DOCUMENTS

| | | | |
|---|---|---|---|
| EP | 728437 | * | 8/1996 |
| FR | 2626016 | * | 7/1989 |
| JP | 9-313427 | * | 12/1997 |
| JP | 2003-185325 | * | 7/2003 |

OTHER PUBLICATIONS

GE appliances web page; product search, built-in dishwashers; 2003.*

Maytag Jetclean dishwasher available Aug. 1999; www.appliances.com.*

* cited by examiner

*Primary Examiner*—James O. Hansen
(74) *Attorney, Agent, or Firm*—George L. Rideout, Esq.; Armstrong Teasdale LLP

(57) ABSTRACT

An outer door panel for an appliance door assembly is provided which includes a frame comprising opposite lateral sides, an outer surface extending from the frame and bowed between the lateral sides, and a recessed control mounting surface extending from the outer surface between the lateral sides.

10 Claims, 8 Drawing Sheets

DISHWASHER DOOR ASSEMBLY

BACKGROUND OF THE INVENTION

This invention relates generally to door assemblies for appliances, and more specifically to dishwasher door assemblies.

Known dishwasher door assemblies typically include an escutcheon therein for providing support for control panel components. Typically, the escutcheon is separately molded from a plastic material and is attached to an upper portion of the door assembly above an outer door panel and generally flush with an outer surface of the door panel. Control buttons, knobs, displays etc. extend through the escutcheon for user manipulation to select and execute desired dishwasher features. See, for example, U.S. Pat. No. 5,453,586.

In some dishwasher doors, however, the escutcheon can disadvantage the door assembly in several respects. For example, attaching a plastic escutcheon to the top of a door panel can compromise the structural rigidity of the door assembly, i.e., reduce stiffness of the door. The reduced stiffness can frustrate proper door alignment with a latch assembly and undesirably increase a required force to latch the door for dishwasher operation. In addition, plastic surfaces of the escutcheon are vulnerable to stains and are difficult to clean due to textured surfaces of the escutcheon that tend to trap dust, dirt and sediment therein. Still further, the escutcheon tends to complicate the construction of the door assembly, which accordingly increases manufacturing and assembly costs of the dishwasher.

At least for the reasons set forth above, consumers and dishwasher users would benefit from a dishwasher door construction that overcomes these disadvantages.

BRIEF DESCRIPTION OF THE INVENTION

In one aspect, an outer door panel for an appliance door assembly is provided which comprises a frame comprising opposite lateral sides, an outer surface extending from said frame and bowed between said lateral sides, and a recessed control mounting surface extending from said outer surface between said lateral sides.

In another aspect, an outer door panel for a dishwasher is provided which comprises a frame comprising a longitudinal axis, an outer surface covering said frame, and a control panel mounting surface within said frame and extending from said frame outer surface, said control panel mounting surface inclined with respect to said longitudinal axis.

In yet another aspect, a dishwasher door assembly is provided which comprises an outer door panel comprising opposite lateral sides and a top edge, an outer surface extending between said lateral sides and said top edge, said outer surface surrounding a recessed control surface disposed beneath said top edge of said outer panel, and an inner door panel attached to said outer door panel.

In still another aspect, a dishwasher door assembly is provided which comprises an outer door panel comprising a bowed outer surface and a recessed control surface depending from said outer surface, and a unitary inner door panel attached to said outer door panel.

DETAILED DESCRIPTION OF THE INVENTION

Figure 1:
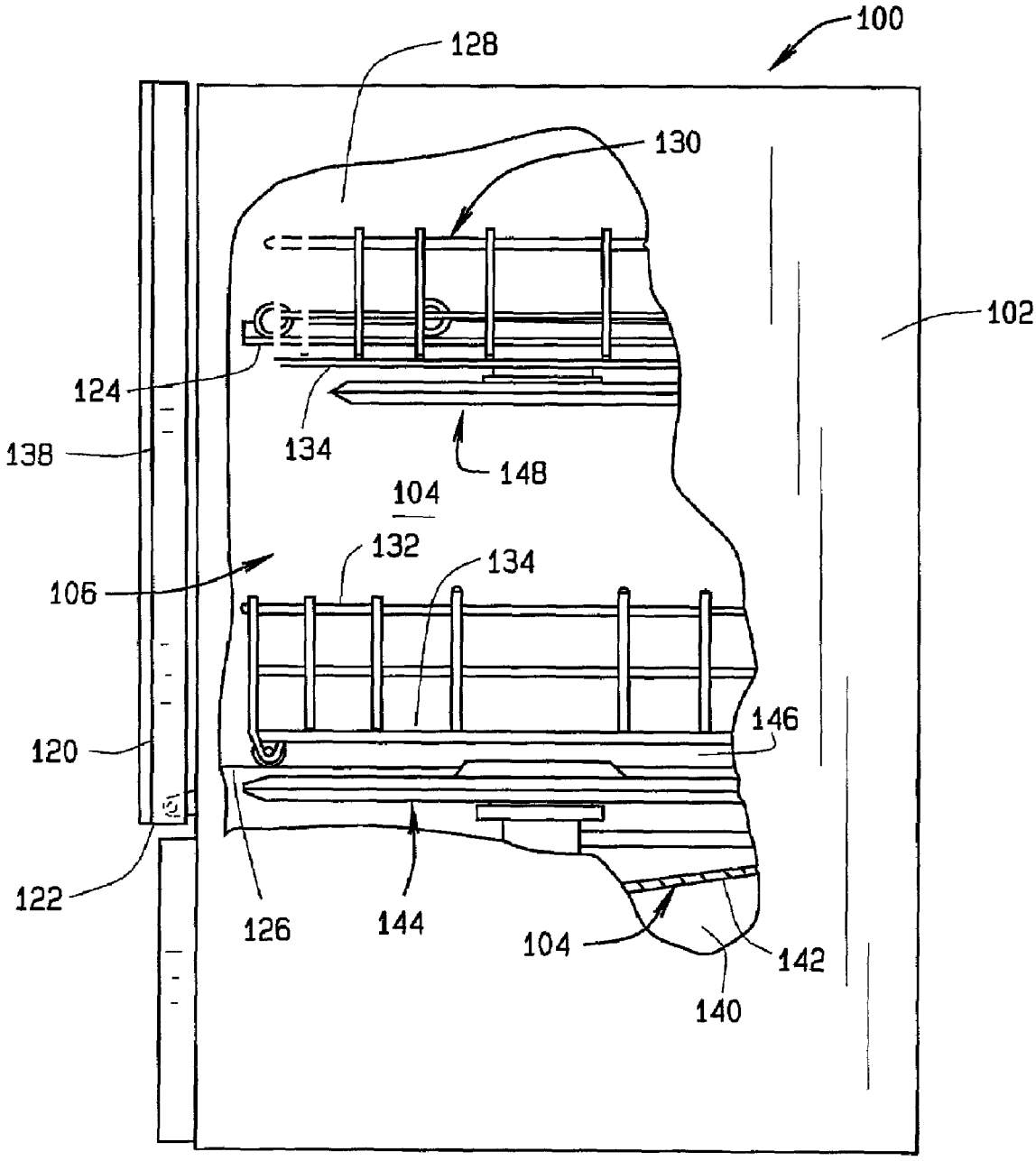
FIG. 1 is a side elevational view of an exemplary dishwasher system partially broken away.

FIG. 1 is a side elevational view of an exemplary domestic dishwasher system 100 partially broken away, and in which the present invention may be practiced. It is contemplated, however, that the invention may be practiced in other types of dishwashers and dishwasher systems beyond dishwasher system 100 described and illustrated herein. Moreover, the door construction described below may find utility and its benefits accrue to appliances generally Accordingly, the following description is for illustrative purposes only, and the invention is in no way limited to use in a particular type of appliance, such as a particular dishwasher system, for example dishwasher system 100.

Dishwasher 100 includes a cabinet 102 having a tub 104 therein and forming a wash chamber 106. Tub 104 includes a front opening (not shown in FIG. 1) and a door assembly 120 hinged at its bottom 122 for movement between a normally closed vertical position (shown in FIG. 1) wherein wash chamber 106 is sealed shut for washing operation, and a horizontal open position (not shown) for loading and unloading of dishwasher contents. Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control panel (not shown in FIG. 1) is mounted at a convenient location on an outer face 138 of door assembly 120 and is coupled to known control circuitry (not shown) and control mechanisms (not shown) for operating a fluid circulation assembly (not shown) that circulates water and dishwasher fluid in dishwasher tub 104. The fluid circulation assembly is located in a machinery compartment 140 located below a bottom sump portion 142 of tub 104. The construction and operation of the fluid circulation assembly is believed to be beyond the scope of the present invention but well within the purview of those in the art without detailed explanation, and further discussion of the fluid circulation assembly is therefore omitted.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 and is located in close proximity to upper rack 130 and at a sufficient height above lower rack 132 to accommodate a largest item, such as a dish or platter (not shown), that is expected to be placed in lower rack 132 and washed in dishwasher system 100. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 provides a rotational force by virtue of washing fluid flowing through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated and door assembly 120 is properly closed to seal wash chamber 106 for operation.

Figure 2:
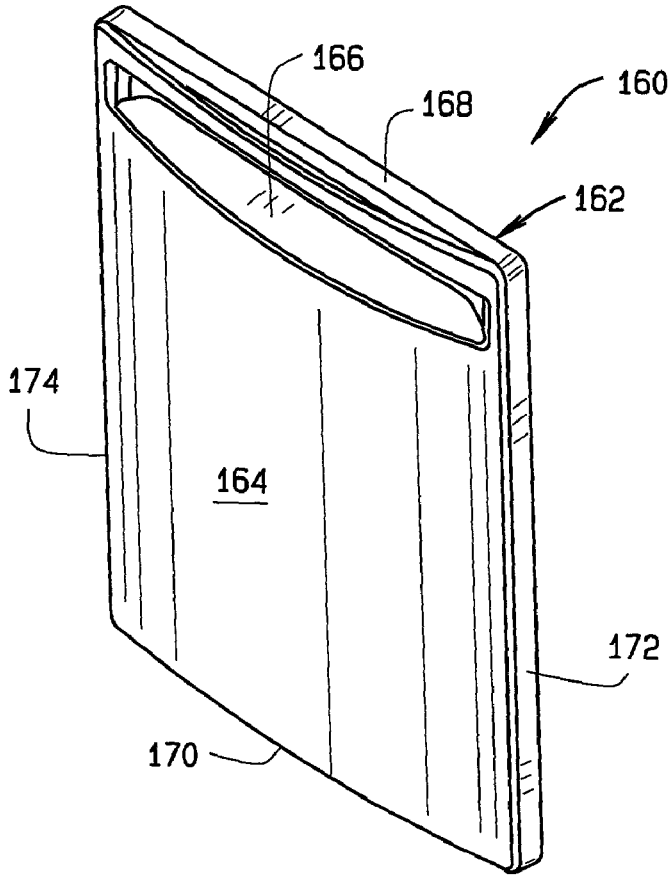
FIG. 2 is a front perspective view of an exemplary outer door panel for the dishwasher shown in FIG. 1.

FIG. 2 is a front perspective view of an exemplary outer door panel 160 for use with an appliance door assembly, such as door assembly 120 (shown in FIG. 1) of dishwasher 100 (shown in FIG. 1). In an exemplary embodiment outer door panel 160 includes a frame 162 and an outer surface 164 covering frame 162. A control panel 166 extends from outer surface 164 and is located in an upper region of outer door panel 160. In one embodiment, control panel 166 includes an electronic membrane switch assembly mounted to a control mounting surface (described further below) of door panel 160 according to known techniques, such as for example, with pressure sensitive tape. The membrane switch assembly includes a plurality of touch sensitive selection keys (not shown) and one or more displays (not shown) for user-selection of dishwasher features and display of information to the user, respectively. It is believed that the aforementioned membrane switch assembly is familiar to those in the art without further explanation, and in alternative embodiments in lieu of the membrane switch assembly a variety of known control panel schemes, whether mechanical, electrical, or electromechanical may be employed with outer door panel 160 using known mounting methods and techniques.

In a particular embodiment, outer door panel frame 162 is generally rectangular and includes a top edge 168, a bottom edge 170 extending opposite to and substantially parallel with top edge 168, and opposite lateral sides 172, 174 extending substantially parallel to one another between top and bottom edges 168, 170. Outer door panel outer surface 164 extends from frame edges 168, 170, 172, 174, and in, one embodiment, is bowed or outwardly curved between lateral sides 172, 174.

Control panel 166 is disposed within frame 162, i.e., between edges 168, 170, and sides 172, 174 so that control panel 166 is mounted to outer door panel 160. Door panel outer surface 164 extends above and below, and on either side of, control panel 166. As such, and unlike known dishwasher door constructions, outer door panel 160 completely surrounds control panel 166 so that outer door panel 160 is structurally rigid and stiff in comparison to conventional escutcheons mounted to a top of a door panel. In an exemplary embodiment, door panel 160 is of single piece or unitary construction, and in a further embodiment is fabricated from metal, such as stainless steel according to a deep drawing process or stamping process known in the art. In alternative embodiments, other known materials are utilized to fabricate outer door panel 160 according to the aforementioned methods or other suitable methods familiar to those in the art.

Unitary construction of outer door panel 160, and the associated structural rigidity, facilitates proper door alignment with dishwasher 100 (shown in FIG. 1) and accordingly reduces a required force to close a latch assembly to seal wash chamber 106 (shown in FIG. 1).

In addition, and further unlike conventional dishwasher door assemblies, outer door panel 160 does not include a escutcheon that tends to complicate assembly of the door. Rather, control panel 166 is mounted directly to outer door panel outer surface 164 via a control mounting surface (described below) extending from outer surface 164. As such, manufacturing costs and assembly costs are saved by eliminating the escutcheon. In addition, textured surfaces of the escutcheon that tend to be difficult to clean are eliminated and replaced with stain resistant painted surfaces adjacent frame top edge 168.

Figure 3:
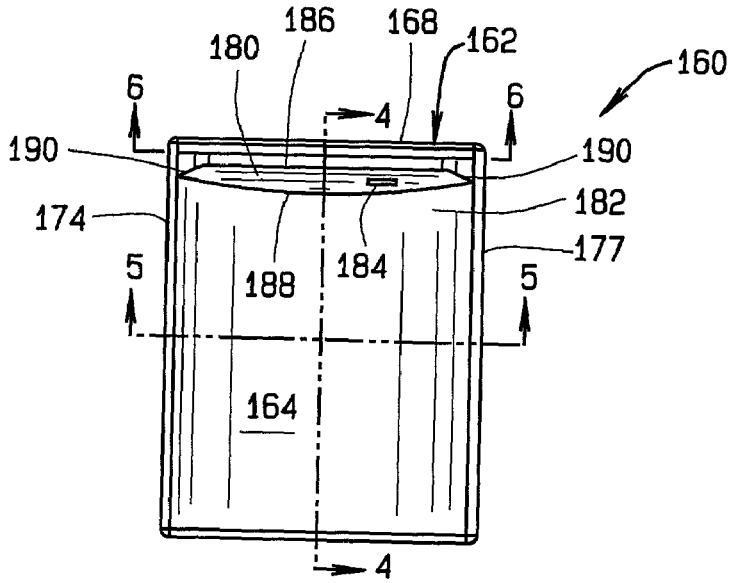
FIG. 3 is a front plan view of the outer door panel shown in FIG. 2.

FIG. 3 is a front plan view of outer door panel 160 illustrating panel outer surface 164 extending over frame 160, and a control mounting surface 180 extending from outer surface between frame Lateral sides 172, 174 in an upper region 182 of frame 162 adjacent frame top edge 168. In an exemplary embodiment, control mount surface 180 is substantially flat or planar and therefore facilitates installation of a control panel, such as panel 166 (shown in FIG. 2). To facilitate wire leads and control panel connections, control mount surface 180 includes an aperture 184 extending therethrough for passing of wires (not shown) of a control panel, such as the membrane switch assembly referred to above in relation to FIG. 1. In further embodiments, control mount surface 180 may include other apertures as desired to facilitate installation of other control panel schemes and associated displays, etc.

In an illustrative embodiment, and as depicted in FIG. 3, control mount surface 180 is saucer-shaped between frame lateral sides 172, 174 More specifically, control mount surface 180 includes a straight side 186 extending beneath and generally parallel to frame top edge 168, an outwardly curved side 188 (concave as illustrated in FIG. 3) extending opposite control mount surface straight side 186 and further extending substantially a full length between frame lateral sides 172, 174, and two angled sides 190 connecting respective ends of control mount surface straight side 186 to respective ends of control mount surface curved side 188. Control mount surface 180 is sized and dimensioned to receive a corresponding control panel, such as the membrane switch control panel 166 (shown in FIG. 2). In alternative embodiments, however, it is contemplated that other shapes of control mount surface 180 may be employed in outer door panel 160.

In one embodiment, control mount surface 180 is integrally formed with a remainder of outer door panel 160 according to a known fabrication process, such as deep drawn metal processes and stamping operations, thereby forming a unitary construction of outer door panel 160 Fabricating control mount surface 180 integrally with door panel 160 further rigidifies the structure of door panel 160 in comparison to known dishwasher door assemblies.

Figure 4:
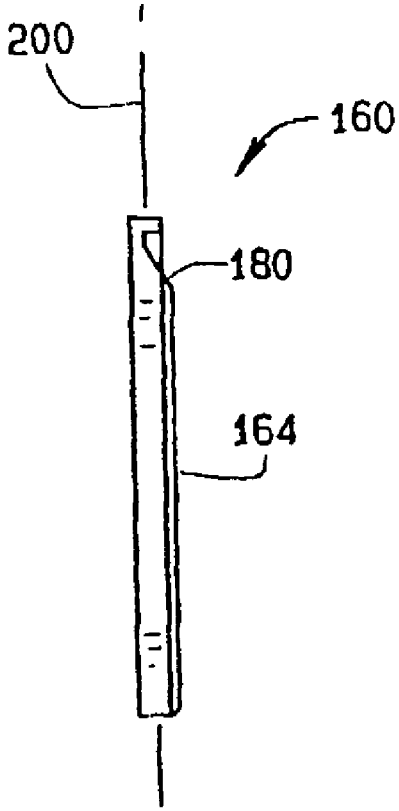
FIG. 4 is a cross sectional schematic view of the outer door panel shown in FIG. 3 along line 4—4.

FIG. 4 is a longitudinal cross sectional schematic view of outer door panel 160 about a longitudinal axis 200, and illustrates control mount surface 180 extending inwardly from bowed outer surface 164 at an angle with outer door panel longitudinal axis 200. In one embodiment, control panel is inclined with respect to panel outer surface 164 and extends at approximately a 60° angle, and in a particular embodiment at a 58° angle with respect to longitudinal axis 200. It is contemplated, however, that greater or fewer angles of control mount surface 180 with respect to longitudinal axis 200 (including control mount surface 180 extending parallel to longitudinal axis 200) may be employed while achieving at least some of the benefits of the instant invention.

Inclined control mount surface 180 allows for a recessed, protected control panel, such as control panel 166 (shown in FIG. 1), to be mounted to control mount surface 180. As such, control mount surface 180 is mostly shielded by an overhanging panel outer surface 164 (see FIG. 1), thereby reducing exposure of the control panel to countertop drips and spills onto panel upper region 182. Thus, difficult to clean areas associated with the control panel are less likely to become soiled.

Figure 5:
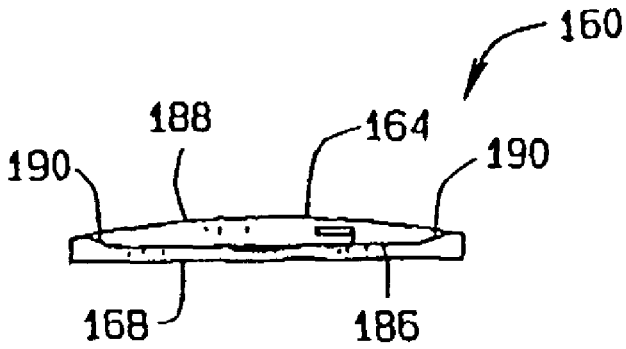
FIG. 5 is a cross sectional schematic view of the outer door panel shown in FIG. 3 along line 5—5.
Figure 6:
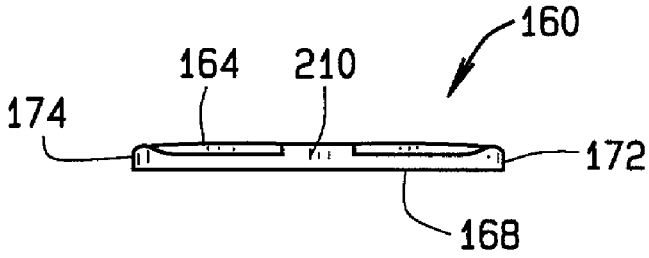
FIG. 6 is a cross sectional schematic view of the outer door panel shown in FIG. 3 along line 6—6.

FIGS. 5 and 6 are cross sectional schematic views transverse to panel longitudinal axis 200 (shown in FIG. 4). Referring to FIG. 5, control panel mount surface 180 (shown in FIGS. 1–3) extends inwardly (downwardly in FIG. 5) from panel outer surface 164 at control mount surface curved side 188 to control mount surface straight side 186 extending generally parallel to frame top edge 168. Control mount surface angled sides 190 extend (upwardly in FIG. 5) from control mount surface straight side 186 to respective ends of control mount surface curved side 188, thereby completing the saucer-shaped control mount surface 180.

Referring now to FIG. 6, a latch portion 210 of outer door panel 160 is illustrated that extends above control panel mount surface 180 (see FIG. 3) and is generally flush with door panel outer surface 164 extending between frame edges 172, 174 and located above control panel mount surface 180 adjacent frame top edge 168.

Figure 7:
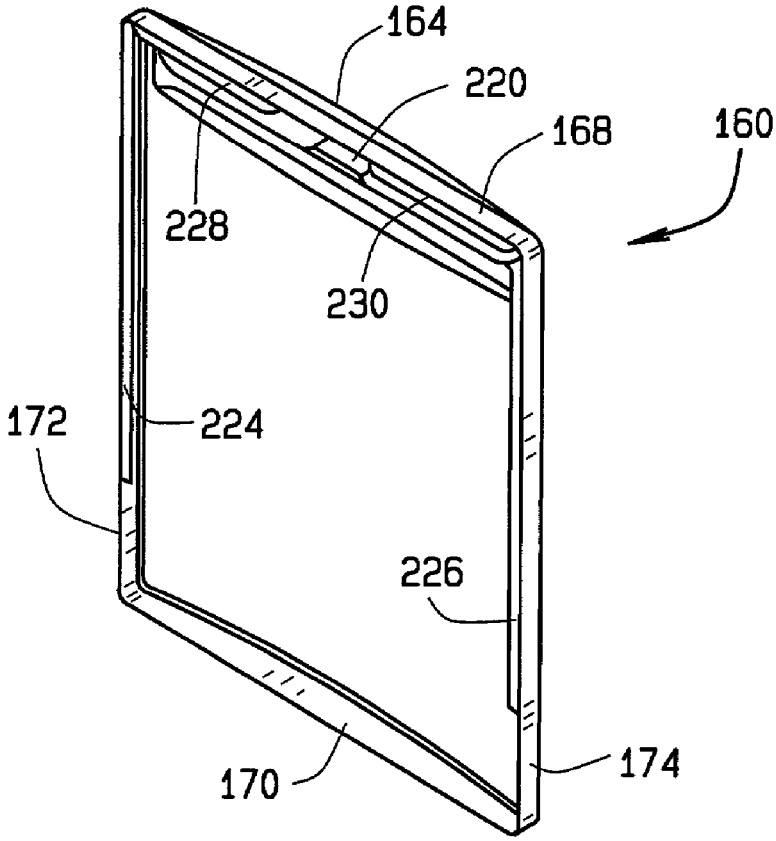
FIG. 7 is a rear perspective view of the outer door panel shown in FIGS. 2–6.

FIG. 7 is a rear perspective view of outer door panel 160 illustrating frame edges 168, 170, 172, and 174 forming a generally box-like configuration, and panel outer surface 164 extending between the edges and generally bowed outwardly between frame lateral sides 172, 174. A door latch 220 extends rearwardly, i.e., away from panel outer surface 164, and substantially parallel to frame top edge 168 for engagement with a latch assembly (not shown) of an inner door panel (described below).

Lateral attachment flanges 224, 226 extend inwardly, i.e., toward a center of outer door panel 160, from frame lateral sides 172, 174, respectively and include a plurality of openings therethrough for receiving known fasteners (not shown) such as screws, for attaching outer door panel 160 to an inner door panel (described below). Attachment flanges 228, 230 also extend from frame top edge 168 and include a plurality of openings therethrough, also for receiving known fasteners (not shown) such as screws, for attaching outer door panel 160 to an inner door panel (described below). In one embodiment, attachment flanges 224, 226, 228, and 230 are integrally fabricated into door panel 160 so that outer door panel is a unitary piece.

Figure 8:
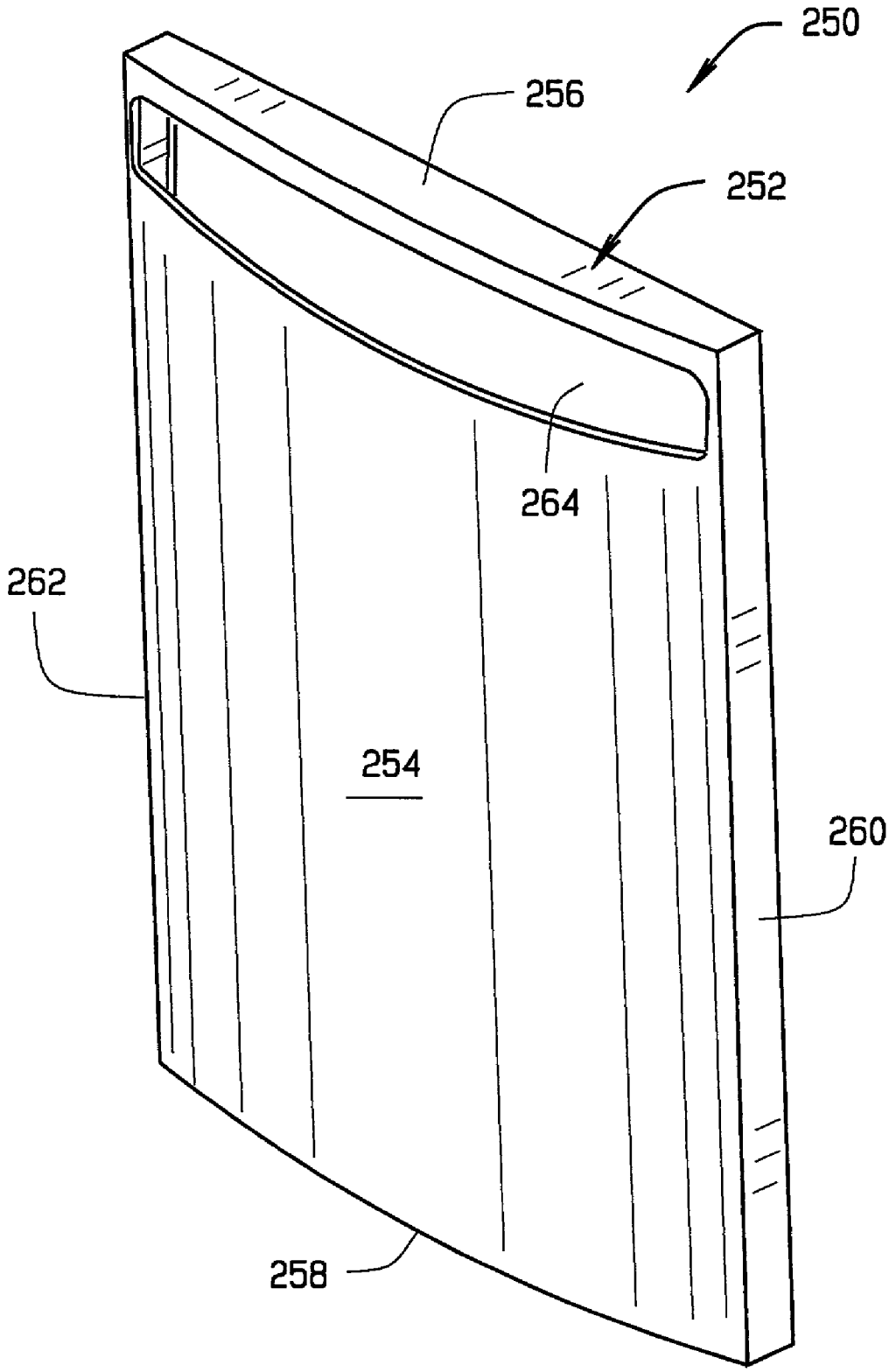
FIG. 8 is a front perspective view of a second embodiment of an outer door panel for the dishwasher shown in FIG. 1.

FIG. 8 is a front perspective view of a second embodiment of an outer door panel 250 for use with an appliance door assembly, such as door assembly 120 (shown in FIG. 1) of dishwasher 100 (shown in FIG. 1). Like outer door panel 160 (shown in FIGS. 2–7), panel 250 includes a frame 252 and an outer surface 254 covering frame 252. Frame 252 includes a top edge 256, a bottom edge 258 extending opposite top edge 256, and lateral sides 260, 262 extending between top edge 256 and bottom edge 258 to form a substantially box-like configuration. Outer surface 254 extends between lateral sides 260, 262 and is outwardly bowed therebetween.

Unlike outer door panel 160, however, door panel 250 includes a control panel cutout portion 264 or opening in lieu of control panel mount surface 180 (shown in FIGS. 3 and 4). As such, panel 250 is simpler to manufacture with known methods and techniques, such as deep drawn metal processes and stamping operations. As illustrated in FIG. 8, panel outer surface 258 completely surrounds cutout portion 264 to maintain rigidity of outer door panel 250. A rigid, unitary door panel 250 is therefore provided that facilitates installation of a control panel (not shown in FIG. 8).

Figure 9:
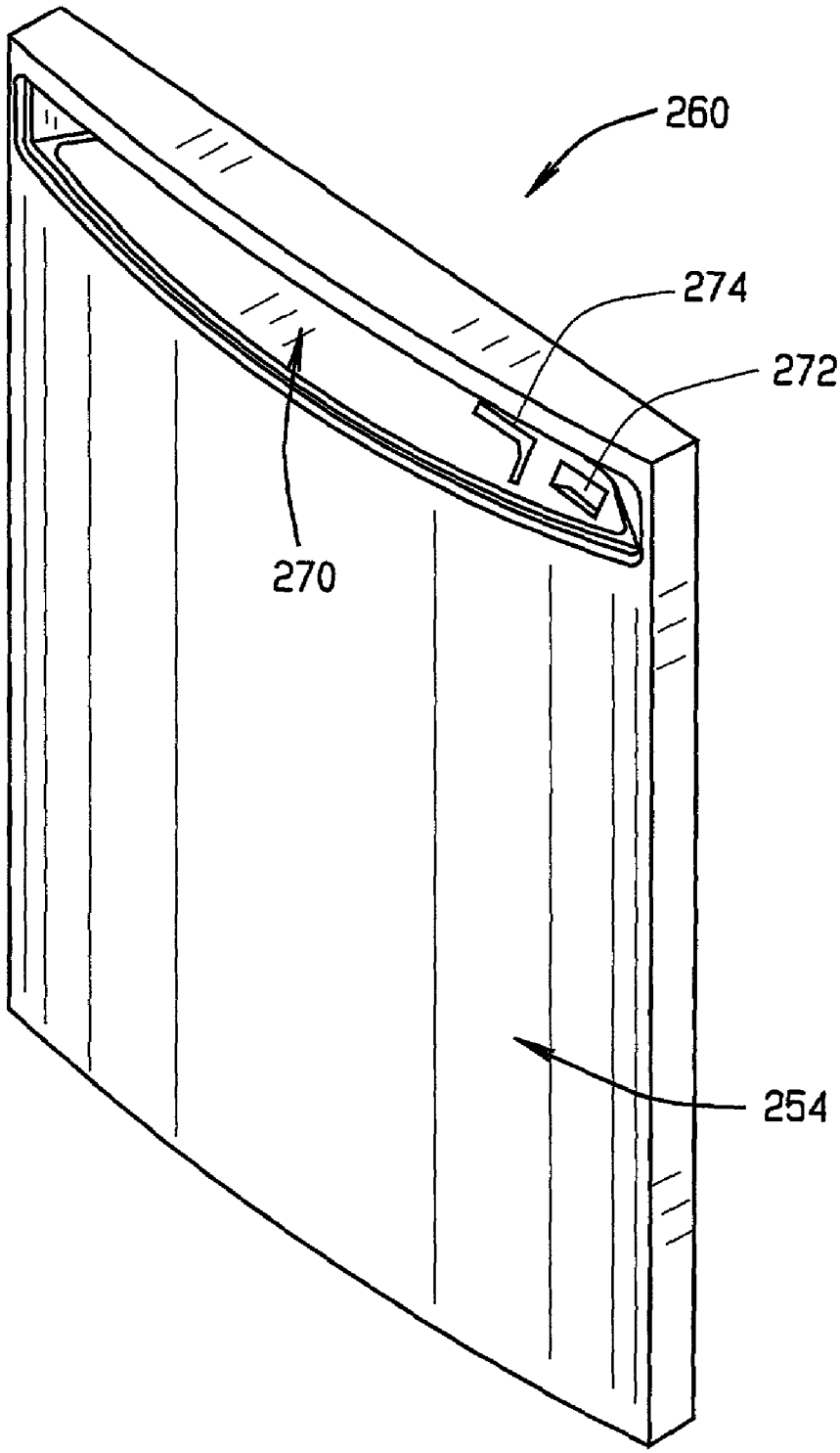
FIG. 9 is a front perspective view of an outer door panel assembly for the door panel shown in FIG. 8.

FIG. 9 is a front perspective view of outer door panel 250 including a control mount surface 270 received in cutout portion 264 (shown in FIG. 8). In an illustrative embodiment, control mount surface is a separately fabricated piece fabricated from, for example, injection molded plastic that is inserted into and engaged with panel cutout portion with known methods and techniques. As such, control mount surface may be considered to be an escutcheon fitted within panel cutout portion 254 without compromising rigidity of the door assembly that tends to frustrate proper door alignment and complicate operation of a door latch assembly (not shown).

Like outer door panel 160, control mount surface 270 is recessed or inclined with respect to panel outer surface 254 so as to protect a control panel scheme mounted on control mount surface 270. Thus, staining of a plastic escutcheon surface is less likely than with conventional dishwasher doors, and maintenance and cleaning of the control panel is less difficult due to a more sheltered control panel in comparison to known dishwasher control panels. Control mount surface 270 is further configured with openings 272, 274 for control system displays and lead wires, and is sized and dimensioned to accommodate a desired control panel scheme, such as a membrane switch assembly.

Figure 10:
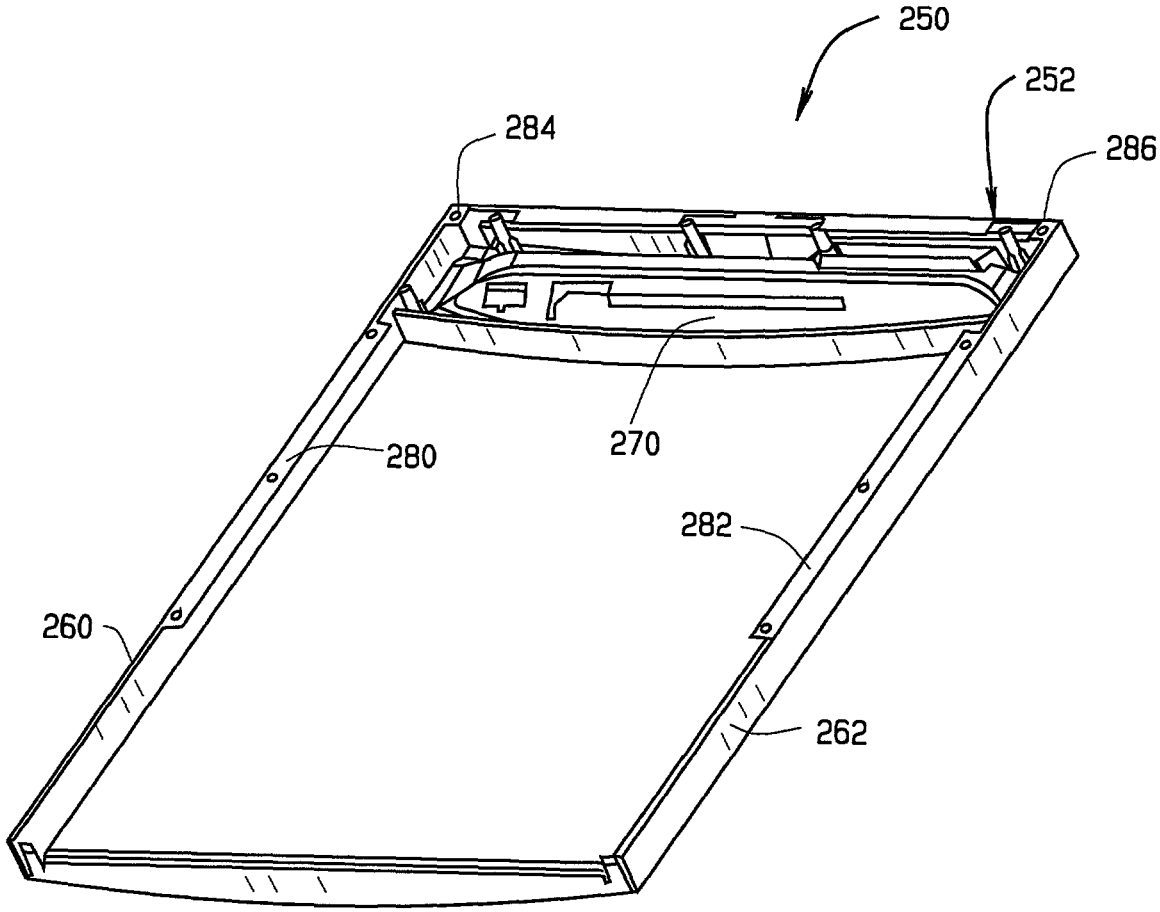
FIG. 10 is a rear perspective view of the outer panel assembly shown in FIG. 9.

FIG. 10 is a rear perspective view of outer panel 250 illustrating attachment flanges 280, 282 extending from frame lateral sides 260, 262, respectively. Flanges 260, 262 include a plurality of openings therethrough for receiving known fasteners (not shown) such as screws, for attaching outer door panel 160 to an inner door panel (described below). Additional attachment flanges 284, 286 are provided in upper corners of frame 252 for attaching outer door panel 250 to an inner door. Control mount surface is received in panel cutout potion 264 (shown in FIG. 8) and attached thereto by known methods.

Thus, panel 250 provides a rigid outer door panel 250 of reduced manufacturing cost while using low cost materials, such as plastic, for control mount surface 270 while avoiding the disadvantages of known plastic escutcheons in dishwasher door assemblies.

Figure 11:
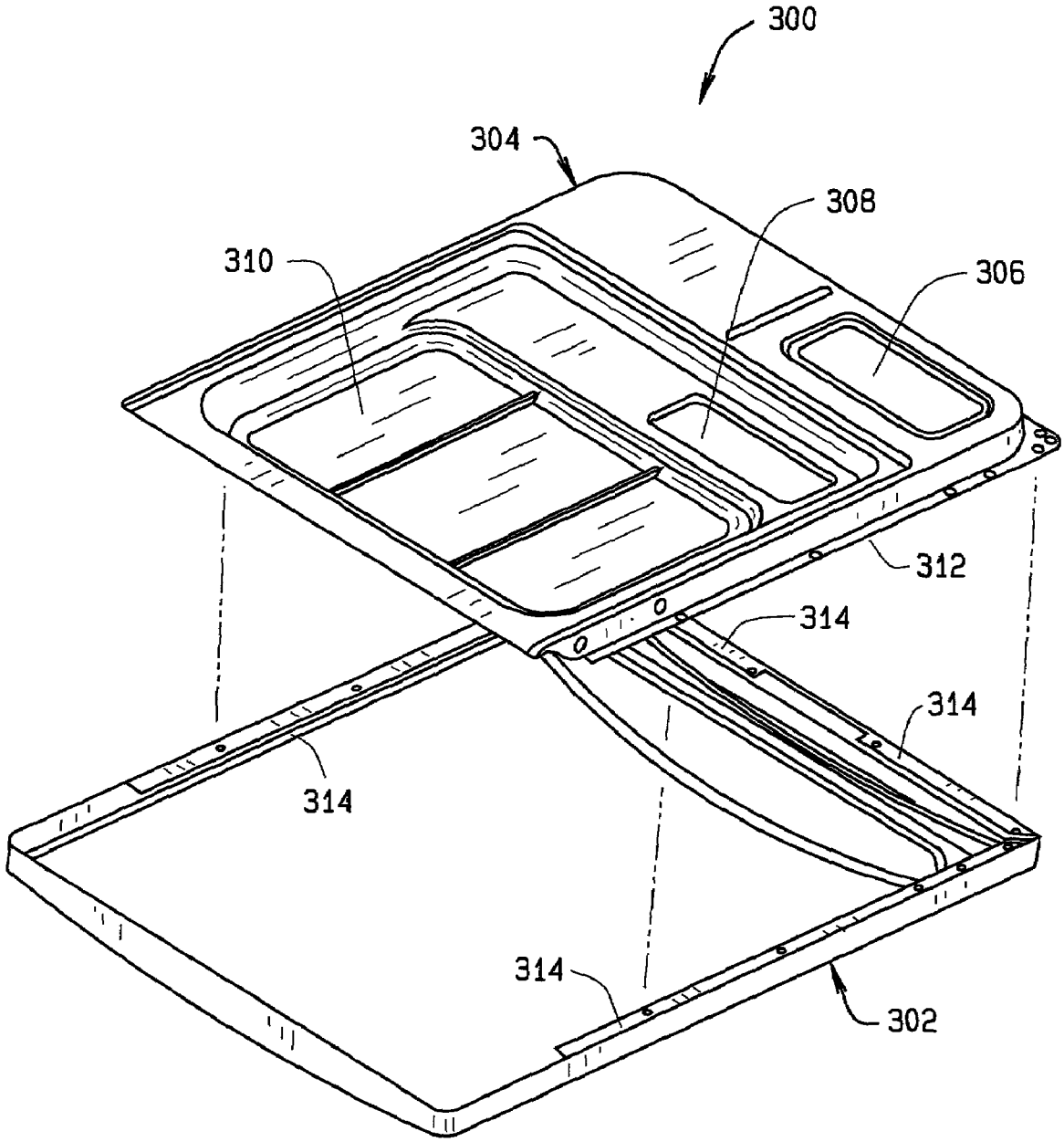
FIG. 11 is an exploded perspective view of a dishwasher door assembly for the dishwasher shown in FIG. 1.

FIG. 11 is an exploded perspective view of a dishwasher door assembly 300 for an appliance, such as dishwasher 100 (shown in FIG. 1). Door assembly 300 includes an outer door panel 302 and an inner door panel 304. Outer door panel 302 may be either of outer door panel 160 (shown in FIGS. 2–7) or outer door panel 250 (shown in FIGS. 8–10) to provide a rigid door construction that is relatively easy to operate, clean and maintain.

Inner door panel 304, in an exemplary embodiment, includes an opening 306 therethrough for a vent assembly (not shown) and an opening 308 therethrough for receiving a detergent dispenser (not shown). Inner door panel 304 is further contoured in a bottom region 310 for accommodating lower rack 132 (shown in FIG. 1) of dishwasher 100 (shown in FIG. 1). It is understood, however, that inner door 300 is intended for illustrative purposes only, and that the outer door panels of the present invention could be used with a wide variety of inner door panels.

In an illustrative embodiment, inner door panel 304 is also of unitary, one piece construction and is fabricated from, for example, plastic materials according to known techniques. Inner door panel 304 is attached to outer door panel 302 via attachment flanges 312 on an outer perimeter of inner door panel 304 fastened to attachment flanges 314 in outer door panel 302. An appliance control module (not shown) and a latch assembly are further accommodated into door assembly 300 as those in the art will appreciate. Also, sealing features and door assembly mounting features, further appreciated by those in the art, complete assembly for installation onto an appliance, such as dishwasher 100 (shown in FIG. 1).

Unitary construction of inner door panel 304 and outer door panel 302 provides a structurally rigid door that will enhance customer satisfaction with a lower cost, improved quality door assembly 300 that is easier to use, clean and maintain than conventional dishwasher door assemblies.

While the invention has been described in terms of various specific embodiments, those skilled in the art will recognize that the invention can be practiced with modification within the spirit and scope of the claims.

What is claimed is:

1. An outer door panel for an appliance door assembly, said outer door panel having a longitudinal axis and comprising:

a frame comprising opposite lateral sides, a top edge, and a bottom edge;

an outer surface extending from said frame, said outer surface outwardly curved between said lateral sides, said outwardly curved outer surface extending from said top to said bottom edges; and a recessed control mounting surface comprising a bottom side and an opposing top side, said recessed control mounting surface extending inwardly and upwardly with respect to said longitudinal axis from said outer surface at said bottom side between said lateral sides, said top side positioned a distance from said top edge, a portion of said outer surface extending between said top side and said top edge of said frame, at a vertical line defined on said outer surface parallel to the longitudinal axis, said top side extending outwardly with respect to the longitudinal axis a first distance and said bottom side extending outwardly with respect to the longitudinal axis a second distance substantially equal to said first distance.

2. An outer door panel in accordance with claim 1 wherein said appliance door assembly is a dishwasher door assembly, said outer door panel defining a control panel cutout, said control mounting surface received within said cutout.

3. An outer door panel in accordance with claim 2 wherein said outer surface is fabricated from metal.

4. An outer door panel in accordance with claim 2 wherein said control mounting surface is fabricated from plastic.

5. An outer door panel in accordance with claim 1 wherein said panel is unitary.

6. A unitary outer door panel for a dishwasher, said outer door panel comprising:

a frame portion comprising opposing lateral sides, a top edge, a bottom edge, and a longitudinal axis;

an outer surface portion extending between said opposing lateral sides and said top and bottom edges of said frame portion, said frame portion and said outer surface portion formed as a single piece, said outer surface portion outwardly curved between said lateral sides, said outwardly curved outer surface portion extending from said top to said bottom edges; and a control panel mounting surface within said frame portion and surrounded by said outer surface portion, said control panel mounting surface comprising a bottom side and a top side, said control panel mounting surface inwardly inclined with respect to said longitudinal axis, such that said control panel mounting surface is mostly shielded by said outer surface portion, a portion of said outer surface extending between said top side and said top edge of said frame, at a vertical line defined on said outer surface parallel to the longitudinal axis, said top side extending outwardly with respect to the longitudinal axis a first distance and said bottom side extending outwardly with respect to the longitudinal axis a second distance substantially equal to said first distance.

7. An outer door panel in accordance with claim 6 wherein said outer surface portion extends above and below, and on either side of said control panel mounting surface.

8. An outer door panel in accordance with claim 6 wherein said control panel mounting surface is configured to receive a control panel.

9. An outer door panel in accordance with claim 6 wherein said control mounting surface is fabricated from plastic.

10. An outer door panel in accordance with claim 9 wherein said outer surface portion and said frame portion are fabricated from a single piece of metal.

* * * * *